US005863171A

United States Patent [19]

Engman

[11] Patent Number: 5,863,171

[45] Date of Patent: Jan. 26, 1999

[54] VEHICLE PARKING CARRIAGES

[75] Inventor: Bengt Engman, Östersund, Sweden

[73] Assignee: Sky Park IC JR AB, Stockholm, Sweden

[21] Appl. No.: 793,041

[22] PCT Filed: Aug. 14, 1995

[86] PCT No.: PCT/SE95/00923

§ 371 Date: Feb. 18, 1997

§ 102(e) Date: Feb. 18, 1997

[87] PCT Pub. No.: WO96/05390

PCT Pub. Date: Feb. 22, 1996

[30] Foreign Application Priority Data

Aug. 16, 1994 [SE] Sweden ..... 9402734-9

[51] Int. Cl.[6] ..... E04H 6/18

[52] U.S. Cl. ..... 414/256; 414/240; 414/241; 414/260; 414/264; 414/232; 104/279

[58] Field of Search ..... 414/227, 231, 414/233, 234, 232, 240, 242, 241, 243, 213, 252, 253, 255, 256, 259, 260, 261, 264, 273, 279, 281; 104/282, 279; 364/478.02

[56] References Cited

U.S. PATENT DOCUMENTS

| | | | |
|---|---|---|---|
| 2,826,312 | 3/1958 | Francis | 414/240 |
| 2,840,248 | 6/1958 | Grove et al. | 414/256 |
| 2,899,087 | 8/1959 | Jacobsen | 414/256 X |
| 4,968,208 | 11/1990 | Friberg | 414/256 |
| 4,986,714 | 1/1991 | Fernström | 414/241 X |
| 5,286,156 | 2/1994 | Ikenouchi et al. | 414/256 |

FOREIGN PATENT DOCUMENTS

| | | | |
|---|---|---|---|
| 1167510 | 4/1964 | Germany | 414/256 |
| 1277546 | 9/1968 | Germany | 414/256 |
| 9110794 | 7/1991 | WIPO | 414/240 |

*Primary Examiner*—Frank E. Werner
*Attorney, Agent, or Firm*—Young & Thompson

[57] ABSTRACT

A vehicle transporting arrangement for transporting a vehicle in a parking building automatically from a drive-in module to a parking space (27), wherein the arrangement includes a first carriage (1), a so-called transfer carriage, which can be moved on and between different parking floors or storeys of the parking building and which includes a second carriage (2) and a third carriage (3), each of which includes lifting devices (4, 5, 6, 7) for lifting and supporting a pair of vehicle wheels, the second and third carriages being positioned sequentially in a direction perpendicular to the direction of movement of the first carriage on a parking floor and being movable in relation to the first carriage at right angles to its direction of movement on a parking floor. According to the invention, at least one of the second and the third carriages (2, 3) includes drive wheels (10) and drive elements for moving the carriage in relation to the first carriage (1).

9 Claims, 2 Drawing Sheets

VEHICLE PARKING CARRIAGES

FIELD OF THE INVENTION

The present invention relates to a vehicle transporting arrangement in a parking building for transporting automatically a vehicle from a drive-in module to a parking place, said transport arrangement including a first carriage which can be moved on and between different parking floors or storeys in the building and which carries a second and a third carriage, wherein each of said carriages includes lifting means for lifting and supporting a vehicle wheel-pair and said carriages being positioned sequentially in a direction perpendicular to the direction of movement of the first carriage on a parking floor and being movable relative to the first carriage in a direction perpendicular to its direction of movement on a parking floor.

BACKGROUND OF THE INVENTION

Vehicle transport arrangements of this kind are known from SE-B-459 110, SE-B-463 219 and SE-B-465 585 and function relatively well. However, it has been found difficult to satisfactorily resolve the problem of moving the vehicle supporting carriages relative to the transfer carriage which carries these carriages as they are transported from and to a respective drive-in module and drive-out module to and from a location opposite a parking space and into and out of a parking space respectively. One cause which contributes to these difficulties is that the distance through which the vehicle, and therewith the vehicle-carrying carriages, shall be moved coincides essentially with the extension of the transfer carriage in the direction of vehicle movement and is therewith long in relation to the space at the disposal of the vehicle moving devices. The transport arrangement described in SE-B-463 219 uses linear gearing which includes two rods that can be moved relative to one another and which are driven by a relatively complicated chain mechanism, said gearing taking-up a relatively small amount of space when the rods are retracted.

SUMMARY OF THE INVENTION

The primary object of the present invention is to solve the problem of moving the vehicle-carrying carriages relative to the transfer carriage to and from a parking space, without using telescopic devices of one kind or another and without requiring a large amount of space to accommodate the vehicle moving arrangement.

This object is achieved in accordance with the invention by means of a vehicle transporting arrangement of the kind defined in the introduction which is characterized in that at least one of the second and the third carriages includes drive wheels and drive means for moving the carriage in relation to the first carriage.

According to one preferred embodiment, only one of the second and the third carriages is equipped with drive wheels and drive means and the second and third carriages are joined together by means of a variable length connection. The second or the third carriage is belt-driven and the belts of said second and third carriages run on rails mounted on the first carriage and also at each parking space, and the second and third carriages are provided a mutually remote ends thereof with brushes which brush the rails clean as respective carriages move therealong. Each belt of the second and the third carriages has provided centrally on its inner surface a longitudinally extending rib which engages a respective groove provided on each wheel of the second and the third carriages, thereby to prevent the belts sliding sideways on the wheels and ensuring that the second and the third carriages will move in a straight line.

In order to ensure that a vehicle will always be moved into a correct vehicle depositing position in a parking space, the parking space is equipped with position sensors which disclose when the second and the third carriages, and therewith also a vehicle carried thereby, are located in a vehicle parking position in a parking space. The first carriage is also equipped with position sensors which disclose when the second and the third carriages, and therewith a vehicle carried thereby, are located in a transport position on the first carriage, wherein the arrangement also includes first-carriage control means which are constructed to move the first carriage only when the second and the third carriages are located in the transport position. This eliminates functional errors due to inexactitudes when driving the carriages, for instance due to the belts slipping in relation to drive wheels or supportive surfaces, these inexactitudes being liable to accumulate with time also to result in an operational breakdown, such breakdowns also being liable to damage a deposited vehicle.

The safety of a vehicle that has been deposited or parked can be further enhanced by providing at least one of the carriages with a device which will detect when a parking space is already occupied, said device advantageously having the form of a Doppler radar.

BRIEF DESCRIPTION OF THE DRAWINGS

The invention will now be described with reference to the accompanying drawings, in which.

BRIEF DESCRIPTION OF THE INVENTION

Figure 1:
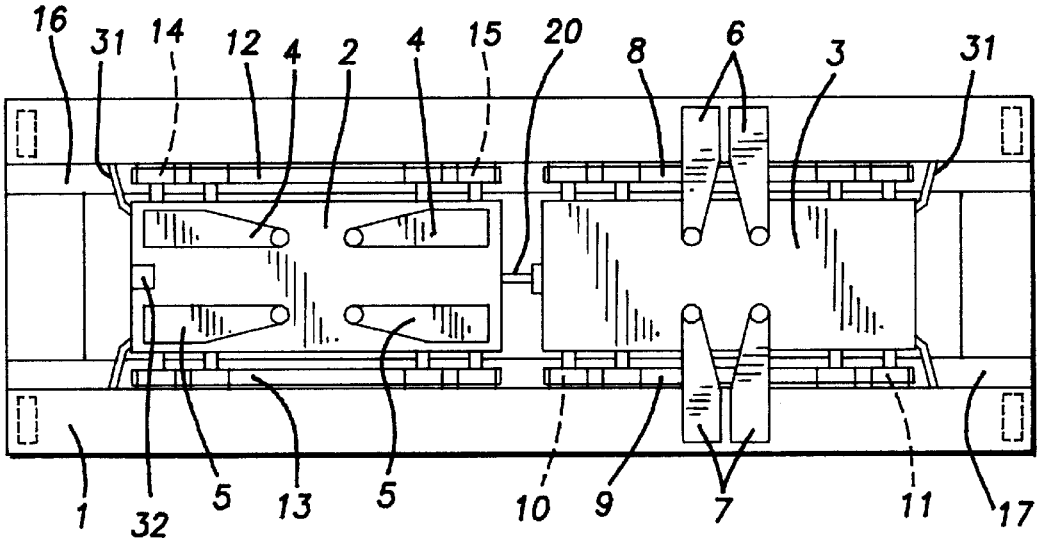
FIG. 1 illustrates one embodiment of an inventive vehicle transport arrangement schematically from above.
Figure 2:
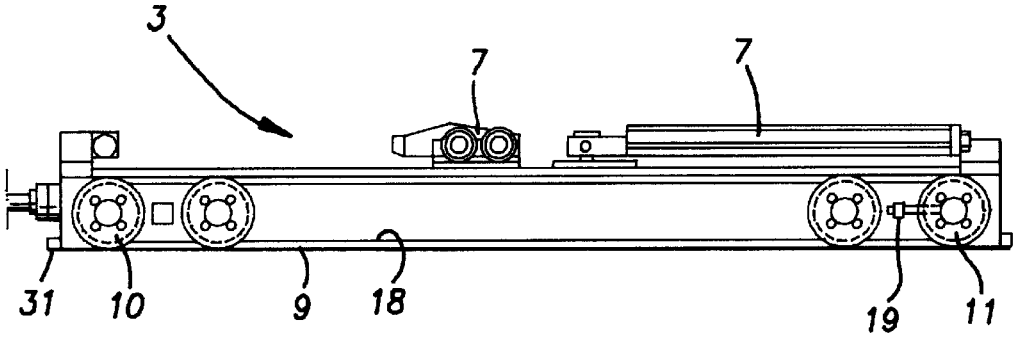
FIG. 2 is a side view of one embodiment of a carriage included in the transport arrangement.
Figure 3:
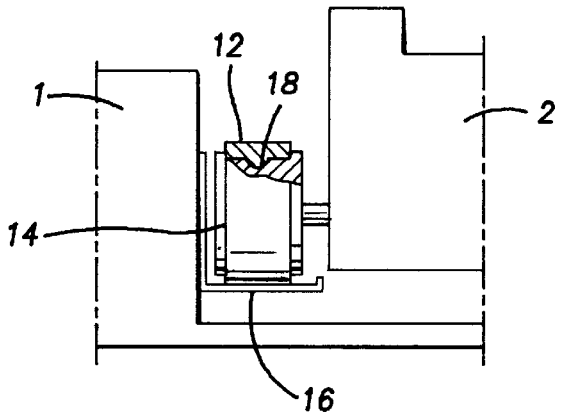
FIG. 3 is a partially cut-away view of part of the transport arrangement shown in FIG. 1.

FIG. 1 illustrates vary schematically a vehicle transporting arrangement which is intended for use in a vehicle parking building of the same type as those described in the aforementioned Swedish published specifications. The transport arrangement includes a first carriage 1, a so-called transfer carriage, and two further carriages, i.e. a second carriage 2 and a third carriage 3 which are movably carried on the transfer carriage 1. The transfer carriage 1 can be moved horizontally on rails on respective parking floors, or storeys, in the parking building and can be moved between floors with aid of hoist arrangements, lifts or elevators. The carriages 2 and 3 are fitted with opposing pairs of lifting blocks 4, 5 and 6, 7 respectively, which can be turned from an inward position, shown with regard to carriage 2 in FIG. 1, to an outward position shown with regard to carriage 3 in FIG. 1. FIG. 2 shows the left lifting block of the pair of lifting blocks 7 in an outwardly turned position, and the right lifting block in an inwardly turned position. The pairs of lifting blocks are conveniently operated with the aid of hydraulic piston-cylinder devices or the like not shown.

FIG. 2 is a side view of the carriage 3. The carriage is belt-driven and includes drive belts 8, 9 which run round wheel-pairs 10, 11, of which the wheels of the wheel pairs 10, 11 that coact with the belt 9 are shown in FIG. 2. The belts 8, 9 may be made of reinforced polyurethane, for instance. The wheel pair 10 is driven by means of a motor (not shown), for instance a hydraulic motor or an electric motor mounted on the carriage 3, wherein the output shaft of the motor drives the wheels of said wheel-pair via an appropriate transmission, in a conventional manner. Each of the wheels may alternatively be driven by its own individual motor. The carriage 2 also includes belts 12, 13, which run round freely-rotating wheels of the wheel-pair 14, 15. The belts 8, 9 of the carriage 3 and the belts 12, 13 of the carriage 2 run on glide rails 16, 17 fitted along the full length of the transfer carriage 1. Each belt has provided on its inner surface a longitudinally extending rib 18 which runs in a groove or channel formed in the wheels of each wheel-pair. This prevents the belts from moving sideways in relation to the wheels. Each carriage 2, 3 also includes a belt tensioning device which may be of any suitable kind and of which the belt-tensioning device 19 that acts on the outermost non-driving wheel-pair 11 of the carriage 3 is shown in FIG. 2.

The carriage 2 of the illustrated embodiment does not include a pair if driving wheels, but is instead connected to the carriage 3 by means of a fixed connection of variable length, for instance a hydraulic piston-cylinder device which is fixedly mounted on the carriage 2 and the piston rod 20 of which is firmly attached to the carriage 3.

The transfer carriage 1 is intended to move a vehicle carried by the carriages 2 and 3 from a drive-in module to an empty parking space on one of the floors of the parking building and from a parking space to a drive-out module respectively. To this end, the carriage 1 is equipped with wheels 21–24 of which at least both wheels of one wheel-pair are driven by means of drive means (not shown) provided on the carriage 1. The wheels 21–24 run on rails 25, 26 on each floor, these rails extending at right angles to two rows of parking places ;27, as illustrated schematically in FIG. 4.

A vehicle is parked in the parking building principally in the same as in the parking building described in SE-B-459 110 and SE-B-465 585, and the parking procedure in this regard will not therefore be described in detail in this document. Thus, when parking a vehicle in the parking building, a vehicle is driven into a drive-in module by the driver of the vehicle, who then leaves the module. Unless already done, the carriages 2 and 3 are then moved from the transfer carriage into the drive-in module, so that the pair of lifting blocks of one carriage will be located opposite the front wheels of the vehicle, whereafter the blocks of this pair are moved from an inwardly turned position to an outwardly turned position and therewith lift and support the front wheels of the vehicle. The second carriage is the moved relatively to the first carriage, and therewith relative to the vehicle by means of the hydraulic piston-cylinder device that connects the carriages 2 and 3 together. During this movement, those lifting blocks of the lifting-block pair of this carriage that are located nearest the front wheels of the vehicle are turned outwardly and movement is interrupted as these lifting blocks engage the rear wheels of the vehicle, whereafter the inwardly turned lifting blocks of these lifting-block pairs are turned outwards so that the vehicle rear wheels will be lifted and supported by the second carriage. The carriages 2 and 3 are then returned to the transfer carriage 1 which transports the vehicle to its intended parking space in the building. All movements of the transport devices are controlled automatically by means of a computer.

Figure 4:
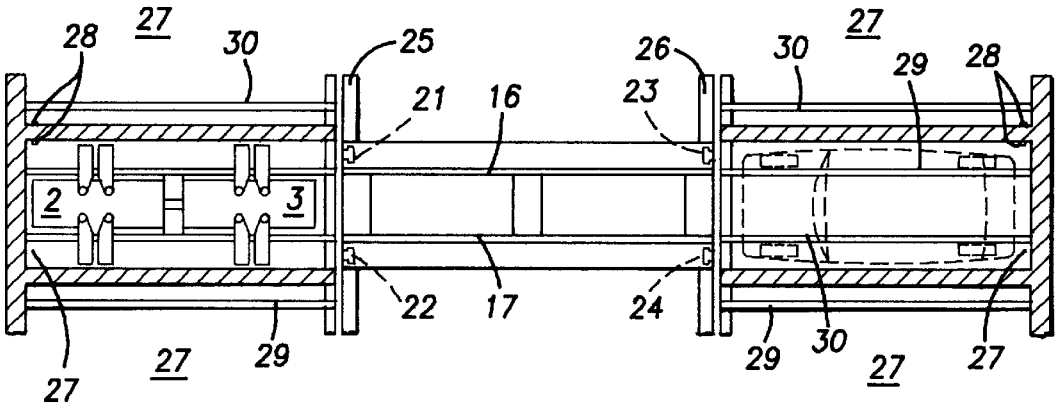
FIG. 4 is a schematic cross-sectional view of part of a parking floor of a parking building.

In the FIG. 4 illustration, the transfer carriage has been stopped in front of an empty parking space 27 in the building and the carriages 2 and 3 have been driven into the parking space on rails 29, 30 provided at each parking space, by activating the drive means of the carriage 3. Each parking space 27 includes position sensors 28 which function to ensure that the vehicle is correctly positioned in the parking space, i.e. that the whole of the vehicle is accommodated in the space and that no part of the vehicle protrudes so as to prevent subsequent movement of the transfer carriage, or to prevent the vehicle from being driven too far into the space and therewith damage the front of the vehicle. The sensors thus detect when the vehicle has been driven to the intended parking position. These position sensors may have the form of inductive sensors mounted on the carriage 2 and magnets mounted in the rails 29, 30 in the parking space. Naturally, other types of suitable position sensors may be used. For instance, photocells may be provided for detecting the position of the vehicle or the position of the front carriage as seen in the direction of vehicle movement. When the parking building includes parking spaces of mutually different lengths which are intended to accommodate vehicles of different lengths, the parking spaces may conveniently also be provided with detectors which detect when the rear end of the vehicle has passed the entrance to the parking space. The signal from the position sensor 28 will thus cause driving of the carriage 3 to stop and the pairs of lifting blocks of the carriages 2 and 3 to be moved inwards, whereafter the carriages 2 and 3 are backed onto the transfer carriage 1 with the lifting blocks in their inwardly turned or swung positions.

In addition to ensuring that the vehicle will not be damaged when depositing the vehicle in a parking space or when leaving the vehicle, the position sensors also ensure that no possible inexactitudes in driving the carriage 3 will be accumulated so that the relative positions of the carriages 2 and 3 and the transfer carriage 1 with respect to time become indefinite, i.e. such inexactitudes in which the distance moved by the carriage 3 does not coincide exactly with the rotational movement of the periphery of the drive wheels, for instance due to slipping between belt and wheel or belt and rails. In order to ensure that the carriage 3 will always be located in precisely the same position on the transfer carriage 1, it may be suitable to provide similar position sensors which sense the relative position of the carriages when the carriages 2 and 3 are placed on the transfer carriage 1, particularly when the position sensors 28 are intended to directly detect the position of the vehicle and not the position of the front parts of the carriages 2 and 3. It is pointed out in this regard that even when the position sensors 28 include coacting devices on the front carriage and in the parking space, it is necessary to provide both carriages 2 and 3 with such devices, since these carriages are driven in either one or the other direction, depending on in which of the parking spaces 27 located on either side of the transfer carriage 1 the vehicle carried by the carriages 2 and 3 is to be parked.

Each of the carriages 2 and 3 is also provided with brushes 31 at their mutually distal ends. These brushes function to brush clean the rails on the carriage and parking spaces in front of the carriage belts.

According to one advantageous variant of the invention, either the carriage 1 or the carriages 2 and 3 is/are provided with means for detecting whether or not a parking space is empty. This will doubly assure that a vehicle carried by the carriages 2 and 3 will not be driven into an occupied parking space should the automatic control of the transfer carriage fail for some reason or other, such that the carriage is stopped in front of an occupied parking space. For instance, a Doppler radar 32 may be fitted to the carriages 2 and 3 as shown in FIG. 1.

A parked vehicle is collected from a parking space and transported to a drive-out module in a corresponding manner.

It will be understood that the illustrated and described embodiment can be modified within the scope of the invention. For instance, the carriage 2 may be provided with drive means for one or more pairs of wheels, in which case the hydraulic piston-cylinder device connecting the carriages 2 and 3 can be omitted. All wheels of the carriages may be driven and the carriages may be driven on conventional wheels instead of belts. The carriage wheels coacting wit the belts may have double flanges which prevent the belts from moving sideways in relation to the wheels, instead of or supplementary to the grooves coacting with ribs on the belts. The invention is therefore limited solely by the content of the following claims.

I claim:

1. A vehicle transporting arrangement for transporting a vehicle in a parking building automatically from a drive-in module to a parking space, the arrangement comprising:

a first carriage including means for moving the first carriage along a direction on different parking floors of the parking building;

a second carriage and a third carriage movably carried on said first carriage, each of said second and third carriages including lifting devices for lifting and supporting a pair of vehicle wheels, said second and third carriages being positioned sequentially in a direction perpendicular to the direction of movement of the first carriage, said second and third carriages being movable in relation to the first carriage in a direction perpendicular to the direction of movement of the first carriage, said second and third carriages being joined together by a connection means having an adjustable length; and at least one of the second and third carriages including drive wheels and drive means for moving said at least one of the second and third carriages relative to the first carriage into and out of a parking space.

2. An arrangement according to claim 1, wherein only one of the second and third carriages includes drive wheels and drive means.

3. An arrangement according to claim 1, wherein at least one of the second carriage and the third carriage is belt-driven.

4. An arrangement according to claim 1, wherein each of the second and the third carriages are driven by belts, the belts of the second and third carriages running on rails mounted on the first carriage and on each parking space; and each of the second and third carriages having mutually remote ends carrying brushes which function to brush the rails clean as the second and third carriages move.

5. An arrangement according to claim 4, wherein each belt of the second and third carriages has mounted on an inner side thereof a central rib which runs in a respective groove provided in each wheel of the second and the third carriages.

6. An arrangement according to claim 1, further comprising position sensors mounted in the parking space and functioning to disclose when a vehicle carried by the second and third carriages is located in a parking position in a parking space.

7. An arrangement according to claim 6, wherein the position sensors are mounted on the first carriage and function to disclose when the second and third carriages, having a vehicle carried thereof, are located in a transport position on the first carriage; and the first carriage includes a control device constructed and arranged to move the first carriage only when the second and third carriages are located in said transport position.

8. An arrangement according to claim 1, wherein at least one of the first, second and third carriages includes means for detecting a parked vehicle in a parking space.

9. An arrangement according to claim 8, wherein the detecting means comprise a Doppler radar.

* * * * *

US005863171C1

(12) EX PARTE REEXAMINATION CERTIFICATE (6625th)

United States Patent
Engman

(10) Number: US 5,863,171 C1
(45) Certificate Issued: Jan. 20, 2009

(54) VEHICLE PARKING CARRIAGES

(75) Inventor: Bengt Engman, Östersund (SE)

(73) Assignee: Apex Skypark, Inc., Placentia, CA (US)

Reexamination Request:
No. 90/008,850, Nov. 5, 2007

Reexamination Certificate for:

| | |
|---|---|
| Patent No.: | **5,863,171** |
| Issued: | **Jan. 26, 1999** |
| Appl. No.: | **08/793,041** |
| Filed: | **Feb. 18, 1997** |

(22) PCT Filed: Aug. 14, 1995

(86) PCT No.: PCT/SE95/00923

§ 371 (c)(1),
(2), (4) Date: Feb. 18, 1997

(87) PCT Pub. No.: WO96/05390

PCT Pub. Date: Feb. 22, 1996

(30) Foreign Application Priority Data

Aug. 16, 1994 (SE) ..... 9402734-9

(51) Int. Cl.
*E04H 6/18* (2006.01)

(52) U.S. Cl. ..... 414/256; 414/240; 414/241; 414/260; 414/264; 414/232; 104/279

(58) Field of Classification Search ..... None
See application file for complete search history.

(56) References Cited

U.S. PATENT DOCUMENTS

| | | | |
|---|---|---|---|
| 3,156,366 | A | 11/1964 | Shutt |
| 4,968,208 | A | 11/1990 | Friberg |
| 4,986,714 | A | 1/1991 | Fernström |

*Primary Examiner*—Joseph A. Kaufman

(57) ABSTRACT

A vehicle transporting arrangement for transporting a vehicle in a parking building automatically from a drive-in module to a parking space (27), wherein the arrangement includes a first carriage (1), a so-called transfer carriage, which can be moved on and between different parking floors or storeys of the parking building and which includes a second carriage (2) and a third carriage (3), each of which includes lifting devices (4, 5, 6, 7) for lifting and supporting a pair of vehicle wheels, the second and third carriages being positioned sequentially in a direction perpendicular to the direction of movement of the first carriage on a parking floor and being movable in relation to the first carriage at right angles to its direction of movement on a parking floor. According to the invention, at least one of the second and the third carriages (2, 3) includes drive wheels (10) and drive elements for moving the carriage in relation to the first carriage (1).

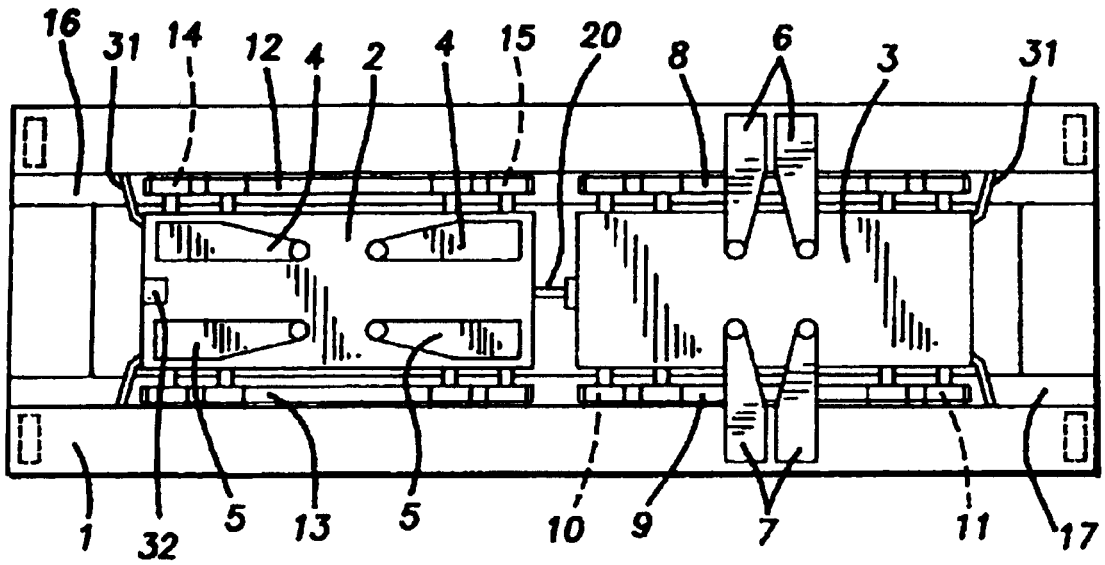

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 4 are determined to be patentable as amended.

Claims 2, 3 and 5–9, dependent on an amended claim, are determined to be patentable.

New claim 10 is added and determined to be patentable.

1. A vehicle transporting arrangement for transporting a vehicle in a parking building automatically from a drive-in module to a parking space, the arrangement comprising:

a first carriage including means for moving the first carriage along a direction on different parking floors of the parking building;

a second carriage and a third carriage movably carried on said first carriage, each of said second and third carriages including lifting devices for lifting and supporting a pair of vehicle wheels, said second and third carriages being positioned sequentially in a direction perpendicular to the direction of movement of the first carriage, said second and third carriages being movable in relation to the first carriage in a direction perpendicular to the direction of movement of the first carriage, said second and third carriages being joined together by a connection means having an adjustable length; [and]

at least one of the second and third carriages including drive wheels and drive means for moving said at least one of the second and third carriages relative to the first carriage into and out of a parking space*;*

*each of the second and the third carriages running on rails mounted on the first carriage and on each parking space; and*

*each of the second and the third carriages carrying brushes which function to brush the rails clean as the second and third carriages move*.

4. An arrangement according to claim 1, wherein each of the second and the third carriages are driven by belts[, the belts of the second and third carriages running on rails mounted on the first carriage and on each parking space; and each of the second and third carriages having mutually remote ends carrying brushes which function to brush the rails clean as the second and third carriages move].

*10. An arrangement according to claim 1, wherein the second and third carriages have mutually remote ends carrying the brushes.*

* * * * *